US009259128B2

(12) United States Patent
Suijver et al.

(10) Patent No.: US 9,259,128 B2
(45) Date of Patent: Feb. 16, 2016

(54) VACUUM CLEANING DEVICE

(75) Inventors: Jan Frederik Suijver, Dommelen (NL); Gerben Kooijman, Heeze (NL); Okke Ouweltjes, Veldhoven (NL); Jeroen Herman Lammers, Eindhoven (NL); Rene Henk Van Der Woude, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/008,010

(22) PCT Filed: Apr. 5, 2012

(86) PCT No.: PCT/IB2012/051678

§ 371 (c)(1),
(2), (4) Date: Sep. 27, 2013

(87) PCT Pub. No.: WO2012/140548

PCT Pub. Date: Oct. 18, 2012

(65) Prior Publication Data

US 2014/0047669 A1 Feb. 20, 2014

(30) Foreign Application Priority Data

Apr. 14, 2011 (EP) ..... 11162421

(51) Int. Cl.
*A47L 5/00* (2006.01)
*A47L 9/04* (2006.01)

(52) U.S. Cl.
CPC ..... *A47L 9/0483* (2013.01); *A47L 9/0461* (2013.01)

(58) Field of Classification Search
CPC ..... A47L 9/0483; A47L 9/0461
USPC ..... 15/363, 379, 381
IPC ..... A47L 9/04
See application file for complete search history.

(56) References Cited

U.S. PATENT DOCUMENTS

| | | | |
|---|---|---|---|
| 5,400,466 | A | 3/1995 | Alderman |
| 7,383,607 | B2 | 6/2008 | Johnson |
| 2005/0278891 | A1 | 12/2005 | Bosses |

FOREIGN PATENT DOCUMENTS

| | | | |
|---|---|---|---|
| JP | 58049129 | A | 3/1983 |

OTHER PUBLICATIONS

Ryan Holman et al., "Formation Criterion for Synthetic Jets", AIAA Journal, vol. 43, No. 10, Oct. 2005, pp. 2110-2116.
J.M. Shuster et al., "A Study of the Formation and Scaling of a Synthetic Jet", AIAA Paper, pp. 2004-0090, 2004.

*Primary Examiner* — David Redding

(57) ABSTRACT

A vacuum cleaning device comprises a unit (1) for aerodynamically affecting dust particles and/or a surface to be cleaned. The unit (1) comprises a housing (30) having a housing wall (31) encompassing two internal sections (20, 22), and a movable surface (11) arranged at an interface of the two sections (20, 22), wherein a portion (32) of the housing wall (31) delimiting a first section (20) is provided with at least one opening (21), and wherein means for actuating the movable surface (11) are arranged in a second section (22). A portion (33) of the housing wall (31) delimiting the second section (22) is adapted to at least hinder exchange of air between an inside of this section (22) and an outside of the housing (30) at the location of this section (22), in order to at least hinder a migration of dust to the second section (22).

12 Claims, 3 Drawing Sheets

VACUUM CLEANING DEVICE

CROSS-REFERENCE TO PRIOR APPLICATIONS

This application is the U.S. National Phase application under 35 U.S.C. §371 of International Application No. PCT/IB2012/051678, filed on Apr. 5, 2012, which claims the benefit of European Patent Application No. 11162421.9, filed on Apr. 14, 2011. These applications are hereby incorporated by reference herein.

FIELD OF THE INVENTION

The present invention relates to a vacuum cleaning device, comprising a unit for aerodynamically affecting dust particles and/or a surface to be cleaned in order for the particles to become dislodged from the surface and to become airborne, wherein the unit comprises a housing having a housing wall encompassing two internal sections, a movable surface arranged at an interface of the two sections, and means for actuating the movable surface, which are adapted to realize an oscillating movement of the surface.

BACKGROUND OF THE INVENTION

Vacuum cleaning is a well-known method for removing dust from surfaces, particularly floors. In general, in the field of vacuum cleaning, a suction force is generated and applied for forcing dust particles to move from a surface to be cleaned to another location such as a canister for collecting the particles. In the process, it may be desirable to agitate the surface in order to facilitate removal of the particles from the surface under the influence of the suction force as mentioned. To that end, it is possible to use a tool for actually contacting the surface to be cleaned. However, it is also known to use another technique, namely a technique which involves the use of a kind of air pump, wherein air waves are generated for vibrating the surface, which can help in releasing dust particles from the surface.

U.S. Pat. No. 7,383,607 discloses an agitation apparatus which is suitable for use in a cleaning head of a vacuum cleaner, and which includes first and second flow paths. Each of these flow paths has a resonant cavity and an inlet/outlet port which joins the cavity to a space within the cleaning head. A generator, such as a loudspeaker with a diaphragm, generates an alternating pressure wave between the ports. Pressure waves are emitted from one of the ports in an anti-phase relationship with the pressure waves from the other of the ports, thus reducing operating noise. When the vacuum cleaner of which the agitation apparatus is part is used for cleaning a carpet, the air motion to/from the ports vibrates the pile of the carpet and serves to draw out dust from between the carpet fibers.

It is noted that the agitation apparatus known from U.S. Pat. No. 7,383,607 helps in releasing dust from a carpet, but there is also a problem associated with this apparatus, which resides in the fact that both resonant cavities are in communication with a space within the cleaning head, through a port. As a result, among other things, it is possible for dust particles to reach the backside of the generator, which is present in one of the cavities. In this way, the functioning of the means for actuating the movable surface of the generator, which are arranged at the backside of the generator, may get disturbed, and it may eventually even be so that the accumulation of dust leads to total failure of the generator.

SUMMARY OF THE INVENTION

It is an object of the present invention to provide a vacuum cleaning device comprising a unit for freeing dust from a surface to be cleaned which is more reliable than the device known from U.S. Pat. No. 7,383,607, wherein there is no longer a problem of accumulation of dust at the backside of the generator, i.e. the side where the means for actuating the movable surface of the generator are arranged, without any negative effects on the basic functioning of the unit. The object is achieved by means of a vacuum cleaning device which comprises a unit for aerodynamically affecting dust particles and/or a surface to be cleaned in order for the particles to become dislodged from the surface and to become airborne, wherein the unit comprises a housing having a housing wall encompassing two internal sections, a movable surface arranged at an interface of the two sections, and means for actuating the movable surface, which are adapted to realize an oscillating movement of the surface, wherein a portion of the housing wall delimiting one of the two sections is provided with at least one opening, wherein the actuating means are arranged in another of the two sections, and wherein a portion of the housing wall delimiting this second section is adapted to at least hinder exchange of air between an inside of this section and an outside of the housing at the location of this section.

According to the present invention, the portion of the housing wall delimiting the section in which the actuating means are arranged is adapted to at least hinder exchange of air between an inside and an outside of the housing at the location of this section, which is referred to as second section. By preventing a free exchange of air from the outside of the housing to the inside of the second section, it is achieved that dust cannot easily reach the inside of the second section, or cannot reach the inside of this section at all. In any case, if there is an accumulation of dust, this will take place at a slower pace than in the device known from U.S. Pat. No. 7,383,607, so that the reliability of the vacuum cleaning device is increased.

An important achievement of the present invention resides in the fact that there is no construction with a port providing free access from an outside space to the second section, while the presence of such a port is essential in the device known from U.S. Pat. No. 7,383,607. The fact is that in the known construction, it is required to expose both sides of the movable surface of the generator to an equal static pressure in order to ensure reliable operation of the generator. It is understood that when one section is closed off from its surroundings, at least to some extent, while another section is still in communication to those surroundings through at least one opening, the principle of having the equal static pressure is disturbed. Especially when use is made of a suction force in the vacuum cleaning device for transporting dislodged particles from the cleaning head to another area inside the vacuum cleaning device, which is the case in the device known from U.S. Pat. No. 7,383,607, under pressure occurs in the first section, i.e. the section having the opening. This phenomenon has a negative impact on the functioning and effectiveness of the generator. Still, the present invention proposes to have a more or less closed second section, as according to an insight underlying the present invention, it is possible to have other ways of pressure equalization than through open communication between each of the sections and an outside space, i.e. a space in which the housing of which the sections are part is located.

A general possibility for realizing pressure equalization proposed by the present invention involves having means for enabling temporary adaptations in the configuration of the unit to take place during operation of the actuating means. According to an insight underlying the present invention, pressure differences between the two sections can be compensated for by controlling the extent to which the portion of the housing wall delimiting the second section is capable of allowing air to pass, and/or by varying the ratio of the volumes of the sections. For sake of completeness, it is noted that in this respect, the oscillating movements of the movable surface itself and possible movements of the actuating means which are necessary for causing these oscillating movements of the movable surface should not be regarded as temporary adaptations in the configuration of the unit, which are adaptations at a larger level compared to the movements as mentioned.

Within the scope of the present invention, it is possible for the portion of the housing wall delimiting the second section of the unit to be provided with at least one opening, wherein means are provided which are movable between a position for closing the opening and a position for leaving the opening open. In such a case, situations in which dust can reach the second section are avoided as much as possible. Even when the opening is left open by the movably arranged means, which may comprise a check valve or the like, there is hardly any risk of dust entering the second section, because the open condition of the opening is particularly relevant in case it is desired to decrease the pressure prevailing inside the second section. In such a situation, air can be expected to flow out of the second section, wherein it is practically not possible that dust travels in an opposite direction.

In an advantageous embodiment, the housing wall delimiting the second section of the unit is fully closed. In such a case, it is ensured that the actuating means cannot be reached by dust, so that the functioning of these means cannot get disturbed on the basis of problems with dust. Furthermore, in such a case, in order to prevent that under pressure occurs in the first section of the unit, measures are taken for allowing for a change the ratio of the volumes of the sections, in such a way that the pressure is continuously equalized.

According to one possibility, the unit comprises means for allowing for a displacement of a whole of the movable surface and the actuating means inside the housing. It is noted that in a practical embodiment, the whole of the movable surface and the actuating means is part of a loudspeaker-like device. In the following, for sake of clarity, this whole will be referred to as generator. When the generator is displaceable inside the housing, and under pressure occurs in the first section, it is possible to take action which is aimed at obtaining the same pressure in both sections again. To this end, the generator is displaced such as to decrease the size of the first section, so that the pressure inside this section increases, and to increase the size of the second section, so that the pressure inside this section decreases.

According to another possibility, the unit comprises a flexible membrane which is arranged in the portion of the housing wall delimiting the second section. In order to prevent dust from reaching the actuating means arranged in the second section, it is preferred if the membrane is airtight. Nevertheless, such a membrane can be acoustically transparent, especially when the mass of the membrane is relatively low and/or the volume between the movable surface and the membrane is relatively small. Furthermore, in order to have acoustic transparency of the membrane, it is preferred if the compliance of the membrane is considerably higher than the compliance of the movable surface. In that case, it is ensured that a remaining static pressure differential between the sections of the unit is minimal. Also, an expansion of the volume between the movable surface and the membrane, causing a decrease of pressure in the second section is then mainly established by displacement of the membrane, wherein a bias displacement of the movable surface is kept minimal.

According to yet another possibility, the generator is movably arranged in the unit, wherein the unit comprises means for guiding the generator in a predetermined direction, and wherein the generator is attached to the housing wall through resilient means. In this arrangement, the generator can move like a piston in a cylinder integrated in the housing, wherein it is possible for the arrangement to be sufficiently airtight, so that a movement of the generator can actually be used for ensuring practically equal pressures in both sections of the housing. The resilient means serve for adding compliance to the generator. When the pressure in the first section drops, the generator is displaced so that the volume of the second section is increased and the pressure prevailing in the second section drops as well.

It is not necessary to make use of one or more components having a movable/displaceable arrangement for compensating for a pressure difference between the sections by adapting the configuration of the unit in an appropriate way. This fact is illustrated by the proposal of another embodiment of the unit, wherein at least one opening is present between the first section and the second section, inside the housing. It will be understood that in order to avoid dust traveling from the first section to the second section as much as possible, it is preferred to keep the number of openings as small as possible, and to keep the size of the at least one opening limited as well. Preferably, the opening or the total of openings is not larger than necessary for realizing pressure equalization to a sufficient extent. In any case, in the embodiment as proposed, a direct inflow of dust in the second section from outside of the housing of the unit is totally prevented. In practice, the inflow of dust from the first section is negligible, as the inflow of dust from outside the housing of the unit to the first section is limited in view of the fact that the first section is only open to the outside through at least one opening, and as there is mainly a flow of air in a direction from the second section to the first section, namely when under pressure is prevailing the first section, which is a situation which is likely to occur in the context of vacuum cleaning.

Within the scope of the present invention, it is very well possible to apply active control for ensuring that pressures are equalized. In particular, in case the unit comprises means for varying the volume of the second section, as is the case in the various possibilities mentioned in the foregoing, the unit may furthermore comprise means for measuring a pressure difference between the first section and the second section, determining a volume of the second section at which the pressure difference is eliminated, and controlling the means for varying the volume of the second section to set the volume as determined. A further example of means for varying the volume of the second section is means comprising a tube-shaped member, and a piston which is movably arranged inside the tube-shaped member, wherein the portion of the housing wall delimiting the second section is provided with an opening, and wherein the tube-shaped member is connected to the housing at the position of the opening. The second section and the tube-shaped member constitute a closed entirety, so that it is not possible for dust to reach the part of the generator which is positioned inside the second section, i.e. the part where the actuating means are located.

According to another example in the context of active control, the unit comprises a passage extending between the first section and the second section, means which are movable between a position for closing the passage and a position for leaving the passage open, and means for measuring a pressure difference between the first section and the second section, determining a position of the movable means at which the pressure difference is eliminated, and controlling the movable means to assume the position as determined. In a practical embodiment, the movable means may comprise a valve, for example.

According to yet another example in the context of active control, the generator is movably arranged in the unit, wherein the unit comprises means for moving the generator in a predetermined direction, wherein the generator is attached to these means, and wherein the unit further comprises means for measuring a pressure difference between the first section and the second section, determining a position of the generator at which the pressure difference is eliminated, and controlling the means for moving the generator to put the generator in the position as determined. With a movable arrangement of the generator, the pressure prevailing inside both the first section and the second section of the unit can be varied without a need for providing an opening in the portion of the housing wall delimiting the second section, so that the second section will always remain free from dust.

In respect of active control, it is noted that the pressure difference between the first section and the second section can be determined by directly measuring the impedance of the generator. As soon as it appears that the impedance deviates from a linear regime, an indication that the pressure gradient over the generator is such that it negatively affects the functioning of the generator is obtained. Hence, the pressure gradient is found in an indirect manner, after which appropriate action can be taken, by providing at least one opening in the portion of the housing wall delimiting the second section, and/or changing the volume of the second section, and/or changing a position of the movable surface inside the housing whereby the ratio of the volumes of the first section and the second section is changed.

In a preferred embodiment of the unit, the actuating means are adapted to realize an oscillating movement of the movable surface that causes air to alternately be drawn into the first section through the opening from various directions at the opening, and expelled from the first section through the opening in the form of a directed jet. In such a case, the movable surface which is part of the unit, and which is used for generating air waves, is actuated in such a way that there is an asymmetry between the suction and the blowing phases. Upon inflow, air is drawn from various directions into the housing of the unit, and upon outflow, a directed jet of air is formed. Consequently, the unit which is part of the vacuum cleaning device according to the present invention may be regarded as means for generating a so-called synthetic jet. During operation of the vacuum cleaner, the oscillating synthetic airflow is used to aerodynamically affect dust particles and/or a surface to be cleaned such that the particles are dislodged from the surface and become airborne. Furthermore, it is possible to use the outgoing directed jet of air for transporting dust particles to a desired position, wherein the traditional suction airflow generated by a fan or the like may be omitted.

At a given vibration frequency and a given geometry of the opening in the portion of the housing wall delimiting the first section of the unit, the directed jet of air is formed when the velocity of the air through the opening is high enough. A generally known number which is applicable here is the so-called Strouhal number, which is defined as follows:

$$Sr = \frac{f * d}{v}$$

in which Sr is the Strouhal number, f is a frequency of the movement of the surface which is part of the generator arranged inside the housing of the unit, d is a characteristic dimension of the opening, and v is an average velocity of the air in the opening in an outflow phase of a cycle of drawing in and expelling air. Generally speaking, for the purpose of ensuring that a synthetic jet is realized, it is advantageous if the Strouhal number is below a certain maximum, wherein the value of this maximum is related to the characteristics of the opening concerned, particularly the shape of the opening. If the opening is an axis-symmetric opening, for example, a circular opening, it is preferred if the following criterion is met: $Sr \leq 1$, and it is more preferred if the following criterion is met: $Sr \leq 0.5$. In that case, the diameter of the opening is the characteristic dimension. Furthermore, if the opening has an elongated rectangular shape, with a long side which is at least 10 times longer than a short side, it is preferred if the following criterion is met: $Sr \leq 0.25$, and it is more preferred if the following criterion is met: $Sr \leq 0.1$. In that case, the length of the short side of the opening is the characteristic dimension. In general, it is preferred if the Strouhal number Sr is not higher than 1.

In principle, the opening in the portion of the housing wall delimiting the first section can have any suitable shape. An example of another possibility than an axis-symmetric shape and an elongated rectangular shape is a square shape. In that case, the length of a side of the opening is the characteristic dimension. When designing an opening with a square shape, it is practical to make use of the criterion which is applicable to the case of the axis-symmetric shape. When designing an opening with a rectangular shape which is not necessarily an elongated rectangular shape, and also not a square shape, it is a feasible option to make use of the criterion which is applicable to the case of the elongated rectangular shape.

For sake of completeness, it is noted that the following two publications are relevant in the field of jet formation criteria:

R. Holman, Y. Utturkar, R. Mittal, B. L. Smith, and L. Cattafesta; *Formation Criterion for Synthetic Jets*; AIAA Journal, vol. 43(10), pp. 2110-2116, 2005; and J. M. Shuster, and D. R. Smith; *A Study of the Formation and Scaling of a Synthetic Jet*; AIAA Paper 2004-0090, 2004.

With the generation of a synthetic jet, contrary to the state of the art known from U.S. Pat. No. 7,383,607, there is no focus on vibrating a surface to be cleaned, and adjusting the frequency of operation such as to realize vibrations which are most effective. Instead, it is important to realize characteristics of geometry and actuation/operation for having a synthetic jet, wherein there is asymmetry in the airflow. In the outflow phase, a directed jet is formed, which is far more effective for dislodging dust particles from a carpet or another surface to be cleaned than the known airflow, which is mainly used for realizing a vibration effect. Moreover, the directed jet can be used for transporting dust particles to a desired position.

Within the context of the present invention, many practical embodiments are feasible, wherein the inside of the second section of the unit which is part of the vacuum cleaning device according to the present invention is protected from dust to at least a considerable extent, while measures are taken for removing pressure differences between the first section and the second section. The measures proposed by the present invention are sufficiently effective, even in cases where an airflow is generated in the vacuum cleaning device for transporting dislodged particles away from the surface to be cleaned, on the basis of which under pressure would occur in the first section which would negatively affect the functioning of the generator arranged inside the housing of the unit in the absence of the measures as mentioned.

The above-described and other aspects of the present invention will be apparent from and elucidated with reference to the following detailed description of a number of embodiments of a unit which is intended to be used in a vacuum cleaning device.

BRIEF DESCRIPTION OF THE DRAWINGS

The present invention will now be explained in greater detail with reference to the figures, in which equal or similar parts are indicated by the same reference signs, and in which.

DETAILED DESCRIPTION OF EMBODIMENTS

Figure 1:
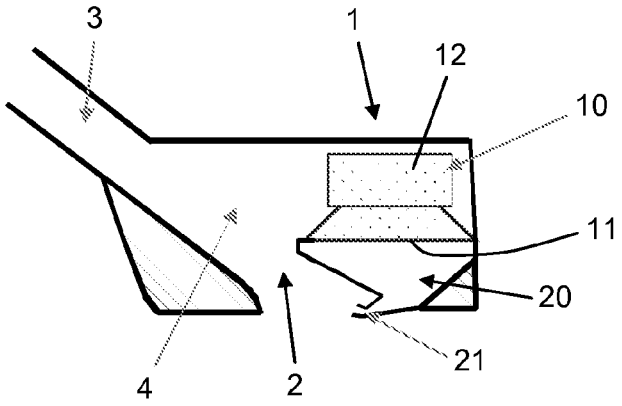
FIG. 1 diagrammatically shows a basic embodiment of a unit which is suitable to be used in a vacuum cleaning device, as arranged in a nozzle of the vacuum cleaning device.

FIG. 1 diagrammatically shows a basic embodiment of a unit 1 which is suitable to be used in a vacuum cleaning device, and serves to illustrate the essence of the operation of the unit 1. In a vacuum cleaning device (not shown in the figures), the unit 1 is used at the position of a nozzle 2 of the device where the action of removing dust from a surface to be cleaned takes place. In the following, it is assumed that the surface to be cleaned is a carpet, which does not alter the fact that the unit 1 is applicable with other types of surfaces as well. In view of the intended use of the unit 1, the unit 1 will hereinafter also be referred to as vacuum cleaning unit 1.

For sake of completeness, it is noted that it is a well-known fact that a vacuum cleaning device serves for removing dust from a surface to be cleaned, which is normally a floor surface. Besides a nozzle 2 for taking in the dust, a conventional vacuum cleaning device comprises means for inducing a suction force at the position of the nozzle and along an internal path from the nozzle 2 to a point for collecting the dust, and means for separating dust from air. In many cases, the nozzle 2 is connected to the dust collection point through suitable tubing. In FIGS. 1-5, a small portion of a tube 3 for transporting the dust away from the nozzle 2 can be seen.

FIG. 1 illustrates the fact that the vacuum cleaning unit 1 comprises a generator 10 which is used for generating air waves and thereby dislodging particles from a carpet to be cleaned, and also a space 20 which is closed to a large extent, except for an opening 21 which is present at a level where the nozzle 2 of the vacuum cleaning device is intended to face the carpet. In the shown example, the generator 10 comes in the form of a loudspeaker 10 having a movable surface 11 in the form of a flexible membrane at a side which is referred to as the front side, and means arranged in a part 12 of the loudspeaker 10 at a side which is referred to as the back side, for actuating the movable surface 11 such as to perform an oscillating movement during operation. In the basic embodiment of the unit 1 as shown in FIG. 1, the back part 12 of the loudspeaker 10 is arranged in a space 22 which is open to the interior 4 of the nozzle 2 of the vacuum cleaning device. In the following, for sake of clarity, the space 22 in which the back part 12 of the loudspeaker is present will be referred to as back space 22, and the other space 20 of the unit 1, i.e. the space 20 which is closed to a large extent except for an opening 21, will be referred to as front space 20. When the vacuum cleaning unit 1 is operated and the means for actuating the movable generator surface 11 are made to perform their function, the movable generator surface 11 is moved at its position at the interface of the spaces 20, 22. The actuating means are adapted to realize a back and forth movement of the generator surface 11, such that an oscillating airflow is obtained. However, the back and forth movement alone does not generate a net airflow. During a blowing phase, i.e. a phase in which air is made to flow out of the opening 21 of the front space 20, there is flow detachment at the position of the opening 21. It is possible for the operation of the actuating means and the geometry of the front space 20 to be adapted to each other in such a way that the detached flow is realized with a sufficiently small Strouhal number, which is determined by a relation between a frequency of the movement of the generator surface 11, a characteristic dimension of the opening 21, and an average velocity of the air in the opening 21 in an outflow phase of a cycle of drawing in and expelling air, as follows:

$$Sr = \frac{f * d}{v}$$

in which Sr is the Strouhal number, f is the frequency as mentioned, d is the characteristic dimension as mentioned, and v is the velocity as mentioned. In case the opening 21 is an axis-symmetric opening, a value of 1, more preferably 0.5, is a practical example of the maximum Strouhal number Sr, and in case the opening 21 has an elongated rectangular shape, a value of 0.25, more preferably 0.1, is a practical example of the maximum Strouhal number Sr.

In respect of the average velocity v of the air in the opening 21, it is noted that in practice, the velocity can be expected to have a certain distribution over the opening 21, and to vary during an outflow phase of a cycle. Therefore, in practice, the velocity v may be determined as the velocity v which is found as the average of various values inside the opening 21, over an entire area of the opening 21, as an average during the outflow phase. The velocity v is determined by various factors, including characteristics of the vibrating motion of the generator surface 11 and geometry of the front space 20. In the context of this geometry, there are other determining factors, such as the size of the generator surface 11, the dimensions of the opening 21, and the volume of the front space 20. The velocity v can be determined in any suitable way, including using an algorithm or performing measurements. Hence, it is possible to actually realize synthetic jet formation and design a vacuum cleaning unit 1 in which the criterion in respect of the Strouhal number Sr is met.

The vibrating motion of the generator surface 11 causes air to be alternately drawn into the front space 20 from the ambient, and expelled again into the ambient. By having the sufficiently small Strouhal number Sr, it is achieved that there is asymmetry between the suction and the blowing phases. Upon inflow, air is drawn from all directions into the front space 20, and upon outflow, a directed jet of air is formed. For sake of completeness, it is noted that alternatives are possible, wherein there may be more openings 21 than just a single one in the front space 20, for example, so that multiple synthetic jets can be created, or wherein a multitude of movable surfaces 11 is arranged in the front space 20 and coupled to a single opening 21, to mention another example.

In the vacuum cleaning device, the oscillating jet flow is used at the nozzle 2 to aerodynamically affect dust particles and/or the carpet, so that the dust is dislodged from the carpet and becomes airborne. Basically, there are two different modes of this use. In the first place, the generator 10 comprising the movable surface 11 and means for actuating the generator surface 11 can be used to suck up dust at inflow, and subsequently eject it towards a dust collection point such as a bag at jet outflow. In the second place, the jet can be directed towards the carpet instead, in order to dislodge dust by blowing. A combination of the two modes in one embodiment is also a possibility.

A problem associated with the basic embodiment of the vacuum cleaning unit 1 as shown in FIG. 1 resides in the fact that the back space 22 is an open space, wherein it is possible for dust to reach this space 22 from the interior 4 of the nozzle 2 in which the unit 1 is arranged. In this way, it may happen that dust accumulates at the back part 12 of the generator 10, and eventually influences the functioning of the generator 10, and may even cause failure of the generator 10, especially when the means for actuating the movable generator surface 11 comprise a magnet-coil assembly, which is the case when the generator 10 is provided in the form of a loudspeaker. According to the present invention, this problem is solved by at least partially closing the back space 22, so that the inflow of dust into the back space 22 is at least hindered. Furthermore, in order to avoid problems with pressure differences over the movable generator surface 11, which may be introduced in this way, and which may influence the functioning of the generator 10 and reduce its effectiveness for dislodging dust from a carpet, the present invention proposes ways for equalizing pressure differences between the front space 20 and the back space 22, for example, by adapting the configuration of the unit 1 during operation, as will be explained in the following with reference to FIGS. 2-8, in which embodiments of a vacuum cleaning unit 1 according to the present invention are shown.

With a back space 22 which is closed, or which is at least closeable by suitable means, the basic configuration of the vacuum cleaning unit 1 according to the present invention can be said to comprise a housing 30 having a housing wall 31 encompassing both the front space 20 and the back space 22, wherein the front space 20 is a first internal section of the housing 30 which is delimited by a first portion 32 of the housing wall 31, and wherein the back space 22 is a second internal section of the housing 30 which is delimited by a second portion 33 of the housing wall 31. The movable generator surface 11 is arranged at the interface of the two spaces 20, 22.

Figure 2:
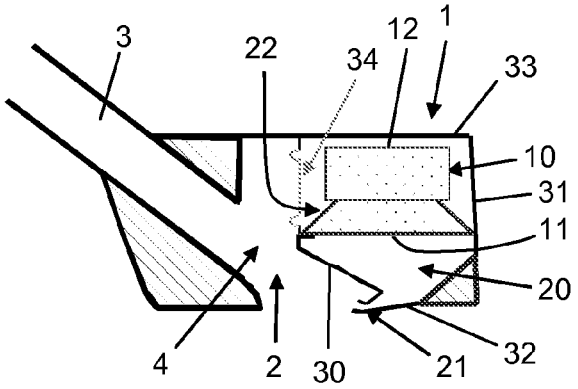
FIG. 2 diagrammatically shows a first preferred embodiment of a unit which is suitable to be used in a vacuum cleaning device according to the present invention, as arranged in a nozzle of the vacuum cleaning device.

In the first preferred embodiment of the vacuum cleaning unit 1 according to the present invention, as shown in FIG. 2, the portion 33 of the housing wall 31 delimiting the back space 22 is fully closed, wherein a flexible and airtight membrane 34 is arranged in this portion 33 of the housing wall 31. On the basis of the fact that the back space 22 is fully closed, it is ensured that the back part 12 of the generator 10 is sealed off from dust. Nevertheless, the membrane 34 is still acoustically transparent, when the intended working frequency of the generator 10 is well below a resonance frequency that is formed by the mass of the membrane 34 and compliance of air between generator 10 and membrane 34. In that case, a quasi-rigid acoustic coupling exists between the membrane 34 and the movable generator surface 11. For this purpose, the mass of the membrane 34 is relatively low and/or the volume between the membrane 34 and (the back of) the movable generator surface 11 is relatively low.

For sake of completeness, in respect of the resonance frequency as mentioned, it is noted that this resonance is defined as follows:

$$f_{res} = \frac{1}{2*\pi}\sqrt{\frac{\rho*c^2*S^2}{m*V}}$$

in which $f_{res}$ is the resonance frequency, ρ is the mass density of the air, c is the speed of sound in the air, S is the area of the membrane 34, m is the moving mass of the membrane 34, and V is the volume of the air between the generator 10 and the membrane 34, i.e. the volume of the back space 22.

Also, it is advantageous if the compliance of the membrane 34 is high, in particular when compared to the compliance of the movable generator surface 11. In that case, it is ensured that a remaining static pressure differential between the interior 4 of the nozzle 2 in which the vacuum cleaning unit 1 is arranged and the back of the movable generator surface 11 is minimal. Furthermore, an expansion of the volume of the back space 22, causing a decrease of the pressure at the back of the movable generator surface 11, which is desired in case under pressure is prevailing in the interior 4 of the nozzle 2, is then mainly established by displacement of the membrane 34, wherein a bias displacement of the movable generator surface 11 is kept minimal. If the compliances of the movable generator surface 11 and the membrane 34 would be equal, under pressure as mentioned would cause both the surface 11 and the membrane 34 to move out equally, wherein the functionality of the surface 11 would be disturbed.

Preferably, the volume between the membrane 34 and the back part 12 of the generator 10 is as small as possible. This will more readily provide the rigid-like acoustic coupling between the membrane 34 and the movable generator surface 11 as described in the foregoing. Also, this will ensure that displacement of the membrane 34 to lower pressure in this volume (to match under pressure prevailing in the interior 4 of the nozzle 2) can be kept small.

In respect of the restriction that the compliance of the membrane 34 must be high, in particular compared to that of the compliance of the movable generator surface 11, it is noted that in order to have a more complete formulation of this restriction, an effect of areas of the membrane 34 and the movable generator surface 11 is considered as well. In practical cases, the restriction reads as:

$$C_m S_m^2 >> C_l S_l^2$$

in which $C_m$, $C_l$ is the mechanical compliance of the membrane 34 and the movable generator surface 11, respectively (i.e. displacement per force), and $S_m$, $S_l$ is the area of each of the components as mentioned.

Alternatively, the working frequency of the generator 10 may be well above the resonance frequency of the membrane 34 as defined in the foregoing, without dropping the other restrictions mentioned in the foregoing. In that case, tuning of the generator 10 and the jet as generated is of a closed box-like nature.

Figure 3:
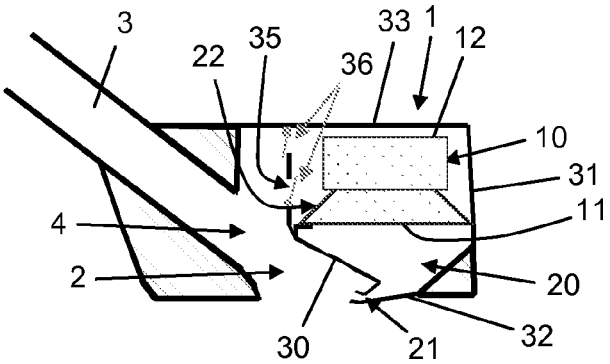
FIG. 3 diagrammatically shows a second preferred embodiment of a unit which is suitable to be used in a vacuum cleaning device according to the present invention, as arranged in a nozzle of the vacuum cleaning device.

FIG. 3 shows a second preferred embodiment of the vacuum cleaning unit 1 according to the present invention. In this embodiment, the portion 33 of the housing wall 31 delimiting the back space 22 is provided with at least one opening 35, at a side adjoining the interior 4 of the nozzle 2, wherein a check valve 36 is arranged in the opening 35. When a pressure difference between the back space 22 and the interior 4 of the nozzle 2 exceeds a certain minimum, namely a minimum which is determined by the spring constant of a spring for keeping the check valve 36 in a default position in which the opening 35 in the housing wall 31 is closed, the check valve 36 opens and allows air to pass. Preferably, the pressure difference needed to put the check valve 36 to a position for leaving the opening 35 open is small, such that a pressure difference over the movable generator surface 11 remains small under all circumstances. Also, for proper operation, it is preferred if the operating frequency of the generator 10 is well above a resonance frequency of the check valve 36, which is determined by a typical mass and compliance of the (spring-loaded) valve 36.

FIG. 3 illustrates an application of two openings 35 and two check valves 36. In such a case, the check valves 36 may be integrated in a single unit. Irrespective of the number of openings 35 and associated check valves 36, it is possible to prevent dust migration to the back space 22 in an open position of the at least one check valve 36 by using at least one filter. In this respect, it is noted that when under pressure occurs in the interior 4 of the nozzle 2, i.e. in the direct vicinity of the back space 22 to which the front space 20 is open, pressure equalization can take place with the check valve 36 in an opened position, wherein air flows out of the back space 22, rather than the other way around.

The operation/tuning of the generator 10 is of a closed box-like nature, wherein the back enclosure of the generator 10 serves as the closed box. In that case, the resonance operating frequency of the generator 10 is determined by the moving mass of the generator 10, the compliance of the movable generator surface 11, and the compliance of air which is present in the closed box.

Figure 4:
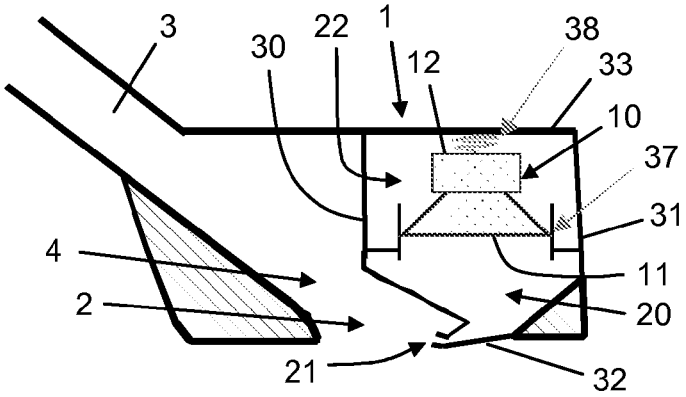
FIG. 4 diagrammatically shows a third preferred embodiment of a unit which is suitable to be used in a vacuum cleaning device according to the present invention, as arranged in a nozzle of the vacuum cleaning device.

FIG. 4 shows a third preferred embodiment of the vacuum cleaning unit 1 according to the present invention, which is also based on a closed box-like operation of the generator 10 and the jet. In this embodiment, the entire generator 10 can move like a piston in a cylinder 37 integrated in the housing 30 of the unit 1, wherein the piston-cylinder arrangement is sufficiently airtight in order to prevent communication between the front space 20 and the back space 22 inside the housing 30. Compliance is added to the generator 10 by means of a spring 38 extending between the generator 10 and the housing wall 31. When under pressure is prevailing inside the front space 20, the generator 10 is made to move towards the front, so that the volume of the back space 20 increases until pressure equalization across the generator 10 occurs (apart from a remaining force needed to extend the spring 38). In respect of the spring 38, it is noted that the orientation of the generator 10 must be considered in view of gravitational force.

Similar considerations hold for the embodiment shown in FIG. 4, i.e. the third preferred embodiment, as for the closed box-like version of the embodiment shown in FIG. 2, i.e. the first preferred embodiment. Hence, it is preferred if the spring compliance is high compared to the compliance of the movable generator surface 11, and the working frequency of the generator 10 is well above the resonance frequency of the (entire) generator 10 and spring 38. Also, sufficient relative expansion of the back enclosure volume of the generator 10 should be accommodated by movement of the entire generator 10 to provide for an adequate decrease of the static pressure.

A variant of the third preferred embodiment can be found when the first preferred embodiment is taken in to account. In such a variant, the generator 10 may be mounted in a membrane which is arranged in the portion 33 of the housing wall 31 delimiting the back space 22.

Considering the embodiments of the vacuum cleaning unit 1 described in the foregoing, other options can be found, wherein both factors of prevention of dust accumulation in the back space 22 and pressure equalization between the front space 20 and the back space 22 are present. For example, it is possible to have an embodiment in which both a filter and a flexible and airtight membrane 34 are arranged in the portion 33 of the housing wall 31 delimiting the back space 22, so that the back part 12 of the generator 10 is connected to the interior 4 of the nozzle 2 of the vacuum cleaner via the filter and the membrane 34 in parallel. In such an embodiment, static pressure equalization is mainly established by the filter, while acoustic transparency is mainly provided by the membrane 34. In this way, high acoustic losses in the filter are circumvented, and the same goes for a large (bias) movement of the membrane 34, while both components still prevent dust migration to the back part 12 of the generator 10.

Similarly, a combination of two membranes 34 can be chosen, which both provide dust protection of the back part 12 of the generator 10. Preferably, in this option, one of the membranes 34 has a high compliance and a resonance frequency well below the operating frequency of the generator 10. This membrane 34 mainly reacts on a quasi static pressure, and hence primarily serves for increasing the volume of the back space 22 to equalize static under pressure. The other membrane 34 has a lower compliance, for example, a compliance which is comparable to the compliance of the movable generator surface 11, and a resonance frequency well above the operating frequency of the generator 10. This membrane 34 mainly reacts on an acoustic pressure, and hence primarily serves for providing acoustical transparency of the back of the movable generator surface 11 to the interior 4 of the nozzle 2 in which the unit 1 is arranged. This alternative set-up may be used for overcoming any practical problems associated with a single membrane 34 which has to provide a large displacement for quasi-static pressure equalization superposed on an acoustic displacement.

Figure 5:
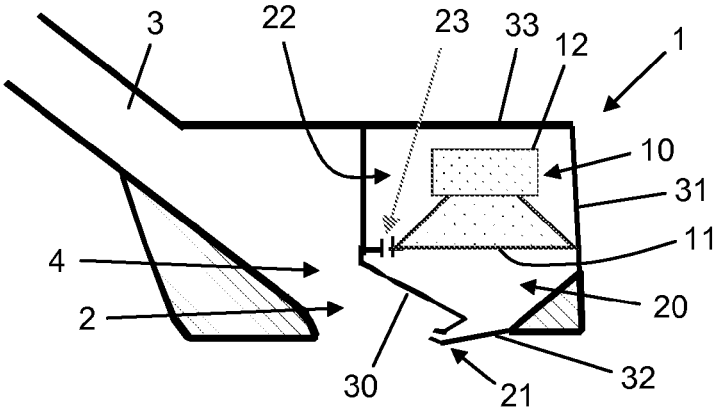
FIG. 5 diagrammatically shows a fourth preferred embodiment of a unit which is suitable to be used in a vacuum cleaning device according to the present invention, as arranged in a nozzle of the vacuum cleaning device.

FIG. 5 shows a fourth preferred embodiment of the vacuum cleaning unit 1 according to the present invention, wherein the housing 30 of the unit 1 is fully closed, with the exception of the opening 21 in the portion 32 of the housing wall 31 delimiting the front space 20. For the purpose of enabling pressure equalization to take place between the front space 20 and the back space 22 when a pressure difference between the spaces 20, 22 arises, an opening 23 is provided at a position between the spaces 20, 22, inside the housing 30. When a pressure difference between the spaces 20, 22 arises, equalization immediately takes place, wherein a flow of air is obtained from the one space 20, 22 to the other, namely from the space 20, 22 where the pressure has the highest value to the space 20, 22 where the pressure has the lowest value.

In the fourth preferred embodiment, there are no movable/displaceable components. Hence, there are no possibilities for adapting the configuration of the unit 1 in order to realize pressure equalization. Furthermore, there are no possibilities for having a totally closed back space 22, and at least one opening 23 is needed for letting in or letting out air. According to the present invention, this opening 23 is chosen such as to be an opening 23 which is present inside the housing 30, so that a problem of dust entering through the opening 23 and accumulating inside the back space 22 still does not need to occur. In the first place, the size of the opening 23 can be kept as small as possible, as long as proper pressure equalization can be realized, wherein pressure differences do not negatively impact the functioning of the generator 10. In the second place, the only possible source of dust is the front space 20, and this source is not a rich one when the fact that only the opening 21 in the portion 32 of the housing wall 31 delimiting the front space 20 allows for communication between the front space 20 and the outside of the housing 30 of the unit 1 is taken into account. Moreover, in practical cases, situations in which the lowest pressure is prevailing inside the front space 20 can be expected to occur far more often than situations in which the lowest pressure is prevailing inside the back space 22, so that any flow of air between the spaces 20, 22 through the opening 23 between the spaces 20, 22 will mainly be from the back space 22 to the front space 22.

If so desired, there can be more than one opening 23 between the spaces 20, 22. Also, it is possible for the at least one opening 23 to be equipped with means for hindering a migration of dust, such as a filter, provided that it is still possible to have pressure equalization to a useful extent during the lifespan of the unit 1. Another possibility is the use of a movably arranged cover or the like at the position of the opening 23.

The fourth preferred embodiment functions in an optimal manner if a working frequency/resonance frequency of the jet generated by the generator 10 is higher than a Helmholtz frequency of the opening 23. It is noted that in practical cases, the opening 23 is provided in a dividing wall or the like between the spaces 20, 22 of the housing 30, so that there is a channel having a Helmholtz frequency, indeed. With the relation of the frequencies as mentioned, the acoustic movement of air in the opening 23 is nil, while the jet is not affected. If this relation would not be guaranteed, the movement of the movable generator surface 11 would cause the acoustic movement of air in the opening 23 as mentioned, which would have an unwanted reducing effect on the jet. The Helmholtz frequency of the opening 23 is determined by the acoustic compliance of the back space 22 and the acoustic mass of the opening 23 (or, in fact, the channel between the front space 20 and the back space 22 at the position of the opening 23), among other factors. A formula for determining the Helmholtz frequency is as follows:

$$f_H = \frac{c}{2*\pi}\sqrt{\frac{S}{V*L}}$$

in which $f_H$ is the Helmholtz frequency, c is the speed of sound, S is the area of a cross-section of the channel at the location of the opening 23, V is the volume of the back space 22, and L is the length of the channel at the location of the opening 23.

Figure 6:
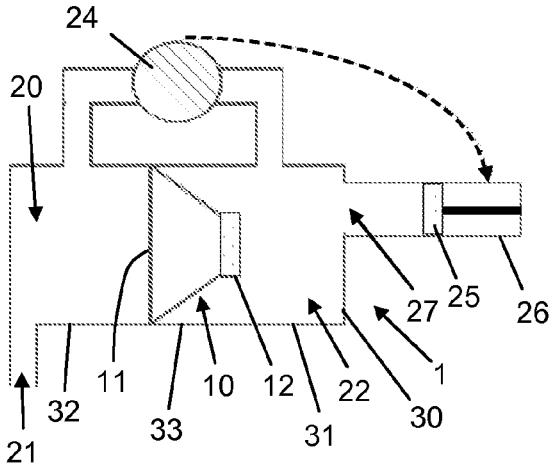
FIG. 6 diagrammatically shows a fifth preferred embodiment of a unit which is suitable to be used in a vacuum cleaning device according to the present invention.
Figure 7:
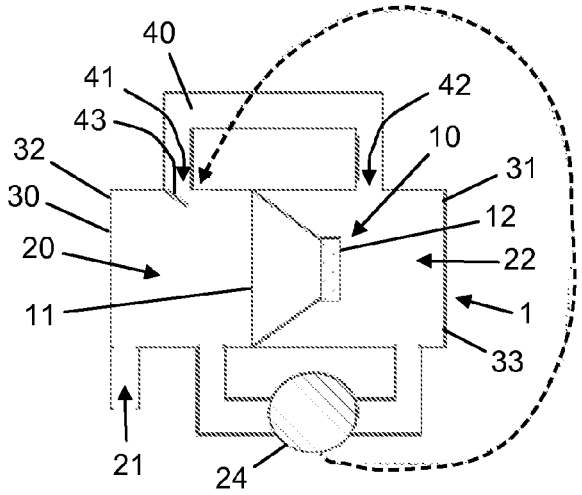
FIG. 7 diagrammatically shows a sixth preferred embodiment of a unit which is suitable to be used in a vacuum cleaning device according to the present invention.
Figure 8:
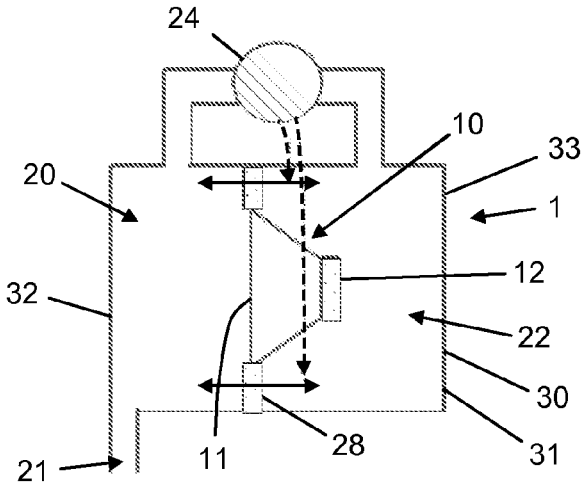
FIG. 8 diagrammatically shows a seventh preferred embodiment of a unit which is suitable to be used in a vacuum cleaning device according to the present invention.

Like FIGS. 2-5, FIGS. 6-8 show a unit 1 for use in a nozzle 2 of a vacuum cleaning device, wherein the unit 1 serves for generating an oscillating airflow, which is advantageously in the form of a synthetic jet, and wherein the unit 1 comprises a generator 10 comprising a movable surface 11. One side of the movable generator surface 11, preferably a front side, is pneumatically connected via an enclosure to an outlet inside the nozzle 2 close to the carpet where the jet is generated, and another side of the movable generator surface 11, preferably a back side, is connected to pressure equalizing means. In the embodiments of the unit 1 as shown in FIGS. 6-8, the pressure equalizing means are actively controlled, on the basis of the outcome of measurements.

FIG. 6 shows a fifth preferred embodiment of the vacuum cleaning unit 1 according to the present invention, which embodiment comprises means 24 for performing a measurement of a pressure difference between the front space 20 and the back space 22 in the housing 30 of the unit 1. Information following from the measurement is subsequently used to actively adapt the volume at the back of the generator 10, i.e. the volume of the back space 22, in such a way as to equalize the pressure. In the fifth preferred embodiment, the volume of the back space 22 can be varied by means of a piston 25 which is movably arranged in a tube-shaped member 26, wherein the tube-shaped member is arranged such as to communicate with the back space 22 through an opening 27 in the portion 33 of the housing wall 31 delimiting the back space 22. In FIG. 6, a control signal from the measuring means 24 to the piston 25 is indicated by means of a dotted arrow.

For sake of completeness, it is noted that there is no air flow possible across the measuring means 24. It is clear that in the fifth preferred embodiment, the back side of the generator 10 cannot be reached by dust, while it is possible to avoid pressure differences over the movable generator surface 11 by using the piston to increase or decrease the volume of the back space 22 in an appropriate way.

For sake of completeness, it is noted that the measuring means 24 may comprise a single component for measuring the pressure difference, but that it is also possible that two components are provided, wherein each of the components is used for measuring the pressure at a side of the movable generator surface 11, and wherein subsequently a comparison is made between the two pressure values.

FIG. 7 shows a sixth preferred embodiment of the vacuum cleaning unit 1 according to the present invention, which embodiment resembles the fifth preferred embodiment to a large extent, at least as far as the application of means 24 for performing a measurement of a pressure difference between the front space 20 and the back space 22 in the housing 30 of the unit 1 is concerned. In the sixth preferred embodiment, there is no piston/tube-shaped member combination for equalizing the pressure, but there is a passage 40 extending between an opening 41 which is present in the portion 32 of the housing wall 31 delimiting the front space 20 and an opening 42 which is present in the portion 33 of the housing wall 31 delimiting the back space 22, and a valve 43 arranged in the passage 40. By means of the valve 43, the passage 40 can be opened, or can be kept closed, depending on the outcome of the measurement. In FIG. 7, a control signal from the measuring means 24 to the valve 43 is indicated by means of a dotted arrow. In order to avoid a possible migration of dust to the back space 22 in an open position of the valve 43, use can be made of a filter which is placed in or near the passage 40.

FIG. 8 shows a seventh preferred embodiment of the vacuum cleaning unit 1 according to the present invention, in which embodiment means 24 are applied for performing a measurement of a pressure difference between the front space 20 and the back space 22 in the housing 30 of the unit 1, as described in respect of the previous two embodiments. For the purpose of enabling equalization of pressure differences, in the seventh preferred embodiment, the generator 10 is movably arranged inside the housing 30. In particular, the generator 10 is mounted on a movably arranged frame 28, which can be made to move in a forward direction and backward direction, so that the generator 10 can move in these directions as well. When the measurement shows that under pressure is prevailing inside the front space 20, the movable frame 28 is controlled such as to move in the forward direction, so that the volume of the front space 20 decreases, and the volume of the back space 22 increases, until the pressure difference between the spaces 20, 22 is removed. In FIG. 8, a control signal from the measuring means 24 to the movable frame 28 is indicated by means of a dotted arrow, and the back and forth movement of the frame 28 is indicated by means of double-headed arrows. Preferably, the whole of the movable frame 28 and the generator 10 is capable of realizing an airtight separation between the two spaces 20, 22, so that the pressure changing effect of a displacement can be optimal, and there is no risk of dust migrating from the front space 20 to the back space 22.

The pressure difference can be measured directly, if so desired. However, it is also possible to measure the pressure difference in an indirect manner, for example, by measuring the impedance of the generator 10 in case the generator 10 is in the form of a loudspeaker. At the operating/resonance frequency, the impedance of a loudspeaker will change significantly, due to a change of electromagnetic coupling and, as a consequence, back electromotive force (back emf) with loudspeaker position. As soon as the impedance leaves a linear regime, it can be concluded that a pressure gradient over the loudspeaker is such that the functioning of the loudspeaker is negatively affected. Subsequently, in order to improve the functioning again, the volume behind the loudspeaker, i.e. the back space 22, is actively changed in such a way as to equalize the pressure, as is the case in the fifth preferred embodiment, or a valve 43 is put to an open position so that air is allowed to flow between the front space 20 and the back space 22, as is the case in the sixth preferred embodiment, or movably arranged means 28 are used for move the loudspeaker, as is the case in the seventh preferred embodiment.

It may also be possible to infer a pressure gradient from the inductance, as this value may change somewhat with the loudspeaker position, and the DC resistance remains the same. Measuring both the impedance and the inductance is a further feasible option for finding a pressure difference over the movable surface 11 of the loudspeaker.

Versions of the embodiments described in the foregoing with reference to FIGS. 6-8 could also be made with a membrane 34 as known from the first preferred embodiment, connecting the back enclosure of the generator 10 to the interior 4 of the nozzle 2 of a vacuum cleaning device, assuming an application of the unit 1 in such a device. Preferably, in such a case, the tuning is such that the membrane 34 moves in phase with the movable generator surface 11. This offers advantages of acoustical cancellation in the interior 4 of the nozzle 2, and no detuning with changing static pressure.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

In this text, only the word "dust" is used for indicating particles that may be removed from a surface to be cleaned by using the vacuum cleaning device according to the present invention. For sake of completeness, it is noted that the present invention is applicable for removing many types of particles, including particles which would normally be referred to than dirt particles rather than dust particles, and which are all assumed to be covered by the use of the word "dust" in this text.

A normal use of the vacuum cleaning device according to the present invention is a use in a normal environment, in which air is surrounding the device. Nevertheless, the present invention is also applicable in case another gas than air is present in the direct vicinity of the vacuum cleaning device. Therefore, it is noted that "air" in this text and the attached claims should be understood such as to represent any possible gas that can be used in the sucking/blowing action that is performed when the unit 1 which is part of the vacuum cleaning device according to the present invention is operated.

In practical cases, the movable surface 11 can comprise a flexible membrane or the like, and can be part of a loudspeaker-like device, as is the case in the shown examples. However, that does not alter the fact that the movable surface 11 may be part of any other suitable type of device in which means for actuating the surface 11 are arranged. For example, the movable surface 11 may be an end surface of a piston, or a surface of piezo material.

The unit 1 having the housing 30 and the two sections 20, 22 is suitable to be used in the field of floor care and vacuum cleaning devices, as explained in the foregoing. Another feasible application of the unit 1 is an application in an air cleaner.

The unit 1 according to the present invention can comprise more than one generator 10, in particular two generators 10, or two or more pairs of generators 10. In embodiments of the unit 1 in which the tuning of the generator 10 is of a closed box-like nature, the resonance frequency (and thereby the intended working frequency of the jet to be generated) is determined by the compressibility of the air behind the generator 10, in the back space 22, among other factors. When the static pressure changes, this resonance frequency changes as well, which is an unwanted effect. A possibility to solve this problem is offered by using two generators 10, which are operated in an anti-phase relationship. In that case, the arrangement of the generators 10 is such that there is no direct communication between the front sides of the generators 10, wherein each of the generators 10 generates a separate jet, while the back sides of the generators 10 are located in the same space, namely a back space 22. On the basis of the anti-phase operation of the generators 10, it is achieved that air which is present inside the back space 22 is not acoustically compressed/expanded. As an advantageous consequence, compressibility of the air in the back space 22 does not play a role in relation to the resonance frequency, and the resonance frequency does not change along with the changing static pressure.

The present invention can be summarized as follows. A vacuum cleaning device comprises a unit 1 for aerodynamically affecting dust particles and/or a surface to be cleaned in order for the particles to become dislodged from the surface and to become airborne. The unit 1 comprises a housing 30 having a housing wall 31 encompassing two internal sections 20, 22, a movable surface 11 arranged at an interface of the two sections 20, 22, and means for actuating the movable surface 11, which are adapted to realize an oscillating movement of the surface 11, wherein a portion 32 of the housing wall 31 delimiting a first section 20 is provided with at least one opening 21, and wherein the actuating means are arranged in a second section 22. A portion 33 of the housing wall 31 delimiting the second section 22 is adapted to at least hinder exchange of air between an inside of this section 22 and an outside of the housing 30 at the location of this section 22. In this way, it is achieved that it is possible to hinder a migration of dust to the second section 22, or to even totally avoid such a migration, which may otherwise lead to malfunctioning or failure of the generator 10. According to an advantageous possibility, the unit 1 comprises means for enabling temporary adaptations in the configuration of the unit 1 to take place during operation of the actuating means. On the basis of an application of such means, a negative influence on the functioning of the generator 10 is avoided by eliminating pressure differences over the movable generator surface 11 which may occur as a side-effect of the hindrance of the dust migration. Another possibility for realizing pressure equalization is having an opening 23 between the first section 20 and the second section 22, inside the housing 30.

The present invention relates to a vacuum cleaning device which is equipped with a unit 1 for aerodynamically affecting dust particles and/or a surface to be cleaned in order for the particles to become dislodged from the surface and to become airborne, wherein the unit 1 comprises a housing 30 having a housing wall 31 encompassing two internal sections 20, 22, a movable surface 11 arranged at an interface of the two sections, and means for actuating the movable surface 11, which are adapted to realize an oscillating movement of the surface 11, wherein a portion 32 of the housing wall 31 delimiting one of the two sections 20, 22 is provided with at least one opening 21, wherein the actuating means are arranged in another of the two sections 20, 22, and wherein a portion 33 of the housing wall 31 delimiting this second section 22 is adapted to at least hinder exchange of air between an inside of this section 22 and an outside of the housing 30 at the location of this section 22.

Furthermore, the present invention relates to a unit 1 for use in a vacuum cleaning device, for aerodynamically affecting dust particles and/or a surface to be cleaned in order for the particles to become dislodged from the surface and to become airborne, comprising a housing 30 having a housing wall 31 encompassing two internal sections 20, 22, a movable surface 11 arranged at an interface of the two sections 20, 22, and means for actuating the movable surface 11, which are adapted to realize an oscillating movement of the surface 11, wherein a portion 32 of the housing wall 31 delimiting one of the two sections 20, 22 is provided with at least one opening 21, wherein the actuating means are arranged in another of the two sections 20, 22, and wherein a portion 33 of the housing wall 31 delimiting this second section 22 is adapted to at least hinder exchange of air between an inside of this section 22 and an outside of the housing 30 at the location of this section 22.

Also, the present invention relates to a unit 1 for use in an air cleaning device, for aerodynamically affecting dust particles, comprising a housing 30 having a housing wall 31 encompassing two internal sections 20, 22, a movable surface 11 arranged at an interface of the two sections 20, 22, and means for actuating the movable surface 11, which are adapted to realize an oscillating movement of the surface 11, wherein a portion 32 of the housing wall 31 delimiting one of the two sections 20, 22 is provided with at least one opening 21, wherein the actuating means are arranged in another of the two sections 20, 22, and wherein a portion 33 of the housing wall 31 delimiting this second section 22 is adapted to at least hinder exchange of air between an inside of this section 22 and an outside of the housing 30 at the location of this section 22.

The invention claimed is:

1. Vacuum cleaning device with a unit for aerodynamically affecting dust particles and/or a surface to be cleaned in order for the particles to become dislodged from the surface and to become airborne, the unit comprising:

a housing having a housing wall encompassing a first internal space and a second internal space, wherein a first portion of the housing wall delimiting the first internal space is provided with at least one opening via which the first internal space is in communication with an outside of the unit;

a movable surface arranged at an interface of the first and second internal spaces;

means for actuating an oscillation in the movable surface, the actuating means being arranged in the second internal space; and means for equalizing a pressure in the first internal space with a pressure in the second internal space, wherein the pressure equalization means comprises at least one component configured to equalize the pressures via at least one of (i) actively controlling an extent to which a second portion of the housing wall delimiting the second internal space is capable of allowing air to pass, and (ii) varying a ratio between a volume of the first internal space and a volume of the second internal space other than by oscillating the movable surface.

2. The vacuum cleaning device according to claim 1, wherein the second portion of the housing wall delimiting the second internal space of the unit is fully closed.

3. The vacuum cleaning device according to claim 1, wherein the second portion of the housing wall delimiting the second internal space of the unit is provided with at least one opening, and wherein the pressure equalization means comprises at least one valve movable between a position for closing the at least one opening and a position for leaving the at least one opening open.

4. The vacuum cleaning device according to claim 1, wherein the pressure equalization means comprises a cylinder and spring configuration for allowing for a displacement inside the housing of a whole of (i) the movable surface and (ii) the actuating means.

5. The vacuum cleaning device according to claim 1, wherein the pressure equalization means comprises a flexible membrane which is arranged in the second portion of the housing wall delimiting the second internal space.

6. The vacuum cleaning device according to claim 1, wherein a whole of (i) the movable surface and (ii) the actuating means is movably arranged in the housing via the pressure equalization means, wherein the pressure equalization means further comprises a cylinder for guiding the whole of (i) the movable surface and (ii) the actuating means in a predetermined direction, and a resilient spring coupled between (a) the whole of (i) the movable surface and (ii) the actuating means and (b) the housing wall.

7. The vacuum cleaning device according to claim 1, wherein the pressure equalization means comprises at least one component configured to vary a volume of the second internal space, the unit further comprising:

at least one component for (i) measuring a pressure difference between the first internal space and the second internal space, and (ii) controlling, via a control signal, the pressure equalization means for varying the volume of the second internal space to a volume at which the pressure difference is eliminated.

8. The vacuum cleaning device according to claim 7, further wherein the pressure equalization means that varies the volume of the second internal space comprises a tube-shaped member and a piston which is movably arranged inside the tube-shaped member, wherein the portion of the housing wall delimiting the second internal space is provided with an opening, and wherein the tube-shaped member is connected to the housing at the position of the opening.

9. The vacuum cleaning device according to claim 1, wherein the pressure equalization means comprises a component having (i) a passage extending between the first internal space and the second internal space and (ii) a valve movable between a position for closing the passage and a position for leaving the passage open, the unit further comprising:

at least one component for (i) measuring a pressure difference between the first internal space and the second internal space, and (ii) controlling, via a control signal, the valve to move the valve to a position at which the pressure difference is eliminated.

10. The vacuum cleaning device according to claim 1, wherein a whole of (i) the movable surface and (ii) the actuating means is movably arranged in the housing via the pressure equalization means, wherein the pressure equalization means further comprises a movable arranged frame for moving the whole of (i) the movable surface and (ii) the actuating means in a predetermined direction, wherein the whole of (i) the movable surface and (ii) the actuating means is attached to the movable arranged frame, the unit further comprising:

at least one component for (i) measuring a pressure difference between the first internal space and the second internal space, and (ii) controlling, via a control signal, the movable arranged frame to move the whole of the movable surface and the actuating means to a position at which the pressure difference is eliminated.

11. The vacuum cleaning device according to claim 1, wherein an oscillating movement of the movable surface causes air to alternately be (i) drawn into the first internal space through the opening from various directions at the opening, and (ii) expelled from the first internal space through the opening in the form of a directed jet.

12. Vacuum cleaning device with a unit for aerodynamically affecting dust particles and/or a surface to be cleaned in order for the particles to become dislodged from the surface and to become airborne, the unit comprising:

a housing having a housing wall encompassing a first internal space and a second internal space, wherein a first portion of the housing wall delimiting the first internal space is provided with at least one opening via which the first internal space is in communication with an outside of the unit;

a movable surface arranged at an interface of the first and second internal spaces;

means for actuating an oscillation in the movable surface, the actuating means being arranged in the second internal space; and means for equalizing a pressure in the first internal space with a pressure in the second internal space, wherein said pressure equalization means comprises a portion of the housing wall having at least one opening in the portion of the housing wall in between the first internal space and the second internal space, further wherein the second internal space is in communication with an outside of the unit via only the first internal space.

* * * * *